US008317161B2

(12) United States Patent
Fujii

(10) Patent No.: US 8,317,161 B2
(45) Date of Patent: Nov. 27, 2012

(54) AIR BALANCER

(75) Inventor: Nobuaki Fujii, Niigata (JP)

(73) Assignee: Endo Kogyo Co., Ltd., Tsubame-shi (JP)

( * ) Notice: Subject to any disclaimer, the term of this patent is extended or adjusted under 35 U.S.C. 154(b) by 427 days.

(21) Appl. No.: 12/604,554

(22) Filed: Oct. 23, 2009

(65) Prior Publication Data

US 2010/0108965 A1 May 6, 2010

(30) Foreign Application Priority Data

Nov. 5, 2008 (JP) ..... 2008-284586

(51) Int. Cl.
*B66D 5/14* (2006.01)
*B66D 5/08* (2006.01)

(52) U.S. Cl. ..... 254/378; 254/379

(58) Field of Classification Search ..... 254/329, 254/330, 331, 378, 379
See application file for complete search history.

(56) References Cited

U.S. PATENT DOCUMENTS 3,635,442 A * 1/1972 Ulbing ..... 254/264
3,933,388 A * 1/1976 Conboy ..... 294/185
5,520,368 A * 5/1996 Braesch et al. ..... 254/274
5,522,581 A * 6/1996 Kulhavy ..... 254/267
5,553,832 A * 9/1996 Zaguroli, Jr. ..... 254/267
5,556,077 A * 9/1996 Braesch et al. ..... 254/267
5,725,199 A * 3/1998 Yamamoto ..... 254/360
5,848,781 A * 12/1998 Kulhavy et al. ..... 254/360
6,370,975 B1 * 4/2002 Nagai et al. ..... 74/89.25
6,547,220 B2 * 4/2003 Johnson ..... 254/331
6,695,292 B2 * 2/2004 Nam ..... 254/267
7,097,156 B2 * 8/2006 Nam ..... 254/331

* cited by examiner

*Primary Examiner* — Emmanuel M Marcelo
(74) *Attorney, Agent, or Firm* — Miles & Stockbridge P.C.

(57) ABSTRACT

An air balancer has a rotary drum on which a rope member is to be wound and that is supported rotatably by a stationary shaft in a casing, a conversion system that converts pressure of first air supplied into the casing into rotational force of the rotary drum for winding the rope member on the rotary drum, a rotary member that is rotatably supported by the stationary shaft and linked with the rotary drum to integrally rotate therewith, a rotation restriction member to be in contact with the rotary member to restrict rotation thereof, a disengagement mechanism that causes the rotation restriction member to retract by pressure of second air supplied into the casing to thereby disengage the contact between the rotary member and the rotation restriction member, and a control module having an air circuit that supplies the second air into the casing only when the first air is supplied into the casing or when the first air is discharged from the casing.

11 Claims, 4 Drawing Sheets

AIR BALANCER

This application claims the benefit of Japanese Patent Application No. 2008-284586 which is hereby incorporated by reference.

BACKGROUND OF THE INVENTION

1. Field of the Invention

The present invention relates to an air balancer or air balancing hoist.

2. Related Background Art

There has been developed an air balancer or air balancing hoist equipped with a braking mechanism for preventing the wire rope from being wound at a high speed to cause flying-up or abrupt pulling-up of the hook when, for example, a load is disengaged from the hook (see, for example, U.S. Pat. No. 5,848,781).

A problem with conventional air balancers is that when a suspended load is raised or lowered, the suspended load does not stop instantaneously but moves up or down by inertia.

SUMMARY OF THE INVENTION

The present invention has been made in view of this problem and has an object to provide an air balancer, that is, air balancing hoist that can prevent the suspended load from moving up or down by inertia when it is raised or lowered to a desired stopping position.

To achieve the above object, according to the present invention, there is provided an air balancer comprising:

a rotary drum on which a rope member is to be wound, the rotary drum being rotatably supported by a stationary shaft in a casing;

a conversion system that converts pressure of first air supplied into said casing into rotational force of said rotary member for winding the rope member on said rotary drum;

a rotary member that is rotatably supported by said stationary shaft and linked with said rotary drum to integrally rotate therewith;

a rotation restriction member to be in contact with said rotary member to restrict rotation thereof;

a disengagement mechanism that causes said rotation restriction member to retract by pressure of second air supplied into said casing to thereby disengage the contact between said rotary member and said rotation restriction member; and a control module having an air circuit that supplies said second air into said casing only when said first air is supplied into said casing or when said first air is discharged from said casing.

It is preferred in the air balancer according to the present invention that said disengagement mechanism comprises a cylinder member into which said second air is supplied, and a piston member held by said cylinder member that is caused to slide by pressure of said second air to push said rotation restriction member to cause it to retract.

It is preferred that the air balancer according to the present invention further comprises an elastic member that biases said rotation restriction member to cause it to be in contact with said rotary member, and a fixing member that fixes said elastic member in said casing, and the biasing force of said elastic member can be adjusted by changing the fixing position of said elastic member in said casing by said fixing member.

It is preferred in the air balancer according to the present invention that said control module further comprises a switching air circuit for supplying said second air always into said casing, and the air balancer further comprises switching means for selectively enabling said air circuit and said switching air circuit in said control module.

It is preferred that the air balancer according to the present invention further comprises a lock mechanism including an engaging member that is provided on an end surface of said rotary drum in such a way as to be able to swing toward the outer circumference thereof, a restricting member that restricts swinging of said engaging member until the rotation speed of said rotary drum reaches a specific level, and an engaged member provided outside the outer circumference of said rotary drum.

As described above, the present invention can provide an air balancer that can prevent a suspended load from moving upwardly or downwardly by inertia when the suspended load is raised or lowered to a desired stopping position.

DESCRIPTION OF THE EMBODIMENT

In the following, an air balancer, that is, air balancing hoist according to an embodiment of the present invention will be described with reference to the accompanying drawings.

Figure 1:
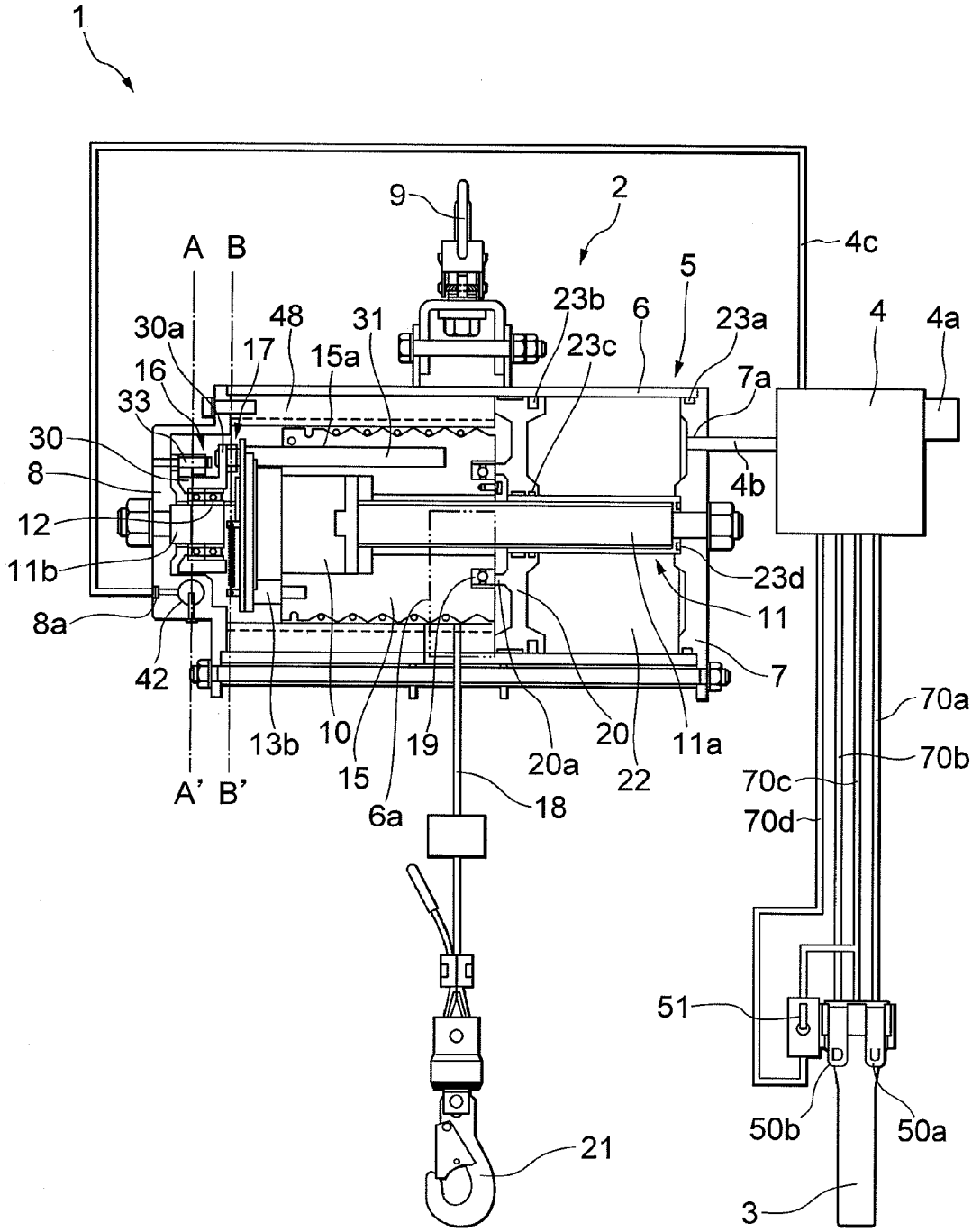
FIG. 1 shows, partly in cross section, the structure of an air balancer 1 according to an embodiment of the present invention.

FIG. 1 shows, partly in cross section, the structure of an air balancer according to an embodiment of the present invention.

As shown in FIG. 1, the air balancer 1 according to the embodiment of the present invention has a main body 2 of the air balancer that suspends a load that is not shown in the drawings to raise and lower the suspended load, an operation handle 3 used to operate the main body 2 of the air balancer, and a control module 4 that controls the operation of the main body 2 of the air balancer based on operations made through the operation handle 3. The control module 4 has an air supply port 4*a* to which a compressor (not shown) that supplies compressed air as the power source of the air balancer 1 is connected.

The casing 5 of the main body 2 of the air balancer is composed of a casing body 6 having a substantially cylindrical shape oriented horizontally and end caps 7 and 8 that close the casing body 6 at opposite sides. The end caps 7 and 8 are provided with air supply ports 7*a* and 8*a* respectively, to which air hoses 4*b* and 4*c* extending from the control module 4 are connected. On the top of the casing body 6 is provided an upper hook 9 for suspending the main body 2 of the air balancer from, for example, a rail mounted on the ceiling of the workplace.

In the casing 5 is provided a fixed or stationary shaft 11 that passes through the end cap 7, extends horizontally inside the casing 5, and passes through the end cap 8. The fixed shaft or stationary 11 is composed of a ball screw shaft portion 11*a* and a spindle portion 11*b*. The ball screw shaft portion 11*a* constitutes a ball screw mechanism together with a ball screw nut 10 provided thereon. On the ball screw shaft portion 11*a*, a drum 15 and an abrupt pulling-up or flying-up prevention apparatus 17 that will be described later are rotatably provided. The drum 15 is fixed to the ball screw nut 10. The flying-up prevention apparatus 17 is fixed to the drum 15 by shafts 13*a* and 13*b* (the shaft 13*a* is not shown in FIG. 1). Thus, the ball screw nut 10, drum 15, and flying-up prevention apparatus 17 can move integrally on the ball screw shaft portion 11*a* along the axial direction while rotating along the screw threads of the ball screw shaft portion 11*a*. On the spindle portion 11*b* of the fixed shaft 11 is rotatably provided an inertial motion prevention apparatus 16 that will be described later via a bearing 12.

The aforementioned drum 15 is a cylindrical member having helical grooves formed on its outer circumferential surface. One end of a wire rope 18 is fixed on the drum 15, and the wire rope 18 is wound on the drum 15 along the helical grooves. A thrust bearing 19 that is coaxial with the fixed shaft 11 is provided on the end face of the drum 15 close to the end cap 7. The thrust bearing 19 is in contact with a projecting portion 20*a* of a piston 20 that will be described later, to allow rotation of the drum 15 relative to the piston 20 with a reduced frictional resistance.

The other end of the wire rope 18 extends downwardly to the exterior of the casing body 6 through an opening 6*a* formed through a lower portion thereof and can be pulled down/pulled up, or lowered or raised with rotation of the drum 15. A lower hook 21 on which a load is to be hung is provided at the end of the wire rope 18.

The piston 20 that is substantially disk- or annular-shaped is provided in the casing 5 in such a way as to be in contact with the inner circumferential surface of the casing body 6 and slidable along the axial direction of the fixed shaft 11. The piston 20 is opposed to the end cap 7 and forms a first air chamber 22 therebetween. On the end surface of the piston 20 at the drum 15 side is formed with an annular projecting portion 20*a* that is in contact with the thrust bearing 19 of the drum 15. Sealing (or packing) members 23*a*, 23*b*, 23*c* and 23*d* are provided between the casing body 6 and the end cap 7, between the casing body 6 and the piston 20, between the piston 20 and the ball screw shaft portion 11*a* of the fixed shaft 11, and between the fixed shaft 11 and the end cap 7 respectively to keep the first air chamber 22 airtight.

With the above-described structure, when air is supplied through the air supply port 7*a* of the end cap 7 into the first air chamber 22, the piston 20 is pushed by the air pressure to slide toward the end cap 8. In consequence, the drum 15 is thrust by the piston 20, whereby it moves toward the end cap 8 while rotating together with the ball screw nut 10, the flying-up prevention apparatus 17, and the inertial motion prevention apparatus 16. Thereby, the wire rope 18 is wound onto the rotating drum 15, whereby the lower hook 21 is raised with the load.

On the other hand, as air in the first air chamber 22 is discharged through the air supply port 7*a*, the lower hook 21 and the load are lowered by their own weight while drawing out or paying out the wire rope 18 from the casing 5. Thereby, the drum 15 moves toward the end cap 7 while rotating in the reverse direction together with the ball screw nut 10, the flying-up prevention apparatus 17, and the inertial motion prevention apparatus 16 to pay out the wire rope 18. The piston 20 is thrust by the drum 15 rotating in the reverse direction to slide toward the end cap 7.

Figure 2B:
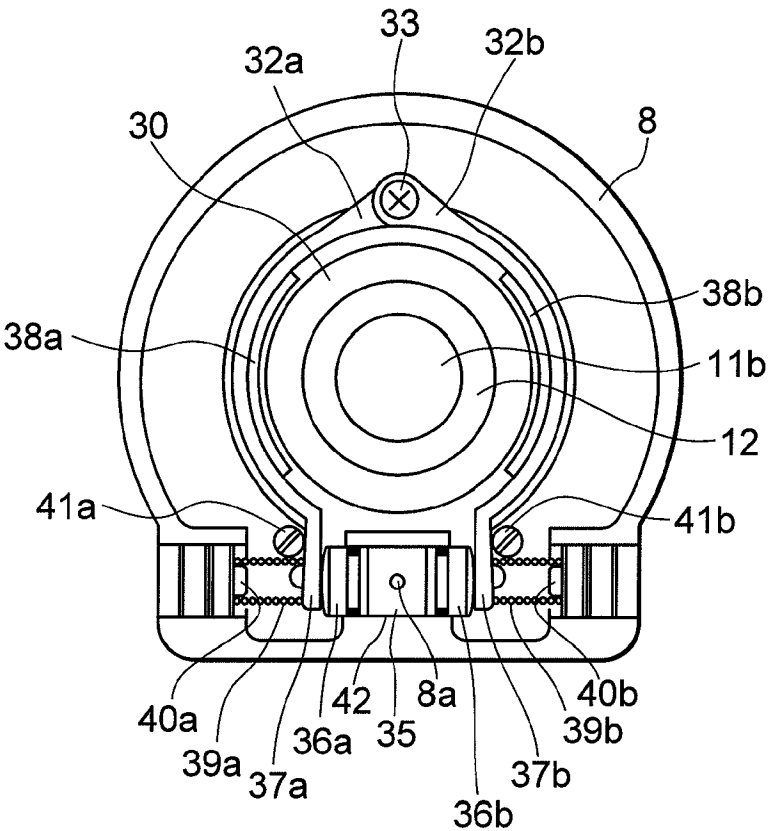
FIGS. 2A and 2B are cross sectional views taken along line A-A' in FIG. 1, showing the structure of an inertial motion prevention apparatus 16 in the air balancer 1 according to the embodiment of the present invention.
Figure 2A:
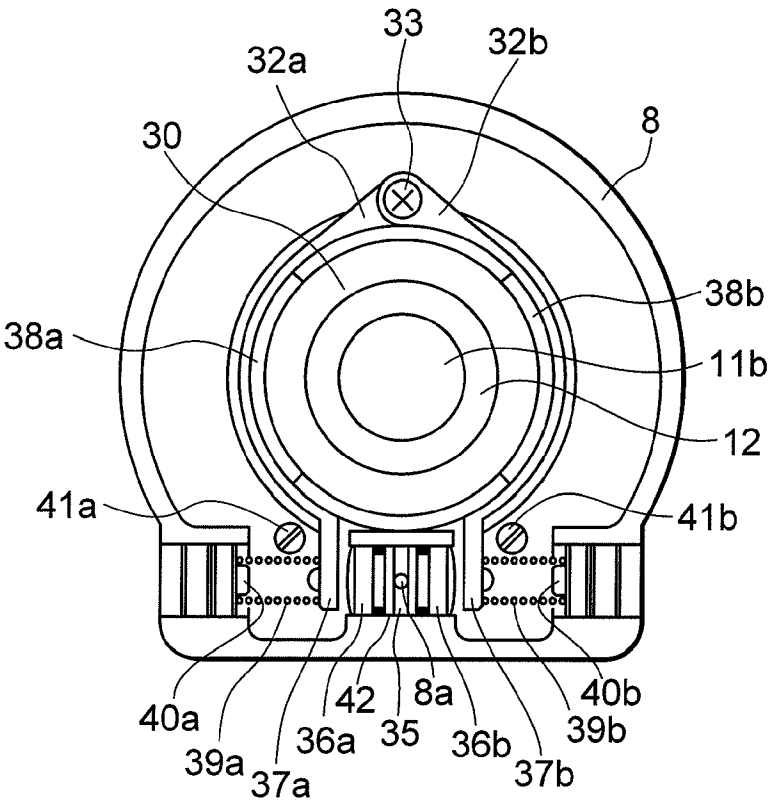

FIGS. 2A and 2B are cross sectional view taken along line A-A' in FIG. 1, showing the structure of the inertial motion prevention apparatus 16 of the air balancer 1 according to the embodiment of the present invention.

The inertial motion prevention apparatus 16 is provided to prevent, when the load hanging on the hook 21 is raised or lowered, the load from moving upward or downward from the desired stopping position by inertia.

As shown in FIG. 1, a cylindrical brake wheel 30 having a flange portion 30*a* partly extending toward a radial direction is rotatably provided on the spindle portion 11*b* of the fixed shaft 11 via the aforementioned bearing 12. A shaft 31 extending in the axial direction of the fixed shaft 11 is fixed on the flange portion 30*a*. The shaft 31 is inserted in a bore 15*a* extending in the axial direction in the drum 15 from the end cap 8 side end surface thereof. The shaft 31 is long enough that it will not get out entirely from the bore 15*a* if the drum 15 moves toward the end cap 7. This engagement of the brake wheel 30 and the drum 15 provided by the shaft 31 enables them to rotate always integrally.

As shown in FIG. 2A, a pair of brake shoes 32*a*, 32*b* having circular arc shapes substantially concentric with the fixed shaft 11 is provided around the brake wheel 30 in such a way as to embrace the brake wheel 30 from opposite sides. One end of each of the brake shoes is pivotally supported by a shaft 33 that is fixed to the end cap 8 and extending to a position directly above the brake wheel 30. The brake shoes 32*a* and 32*b* respectively have extending portions 37*a* and 37*b* provided at the other ends thereof. The extending portions 37*a* and 37*b* extend downwardly to be opposed to pistons 36*a* and 36*b* of a second air chamber 35 that will be described later from outside.

On the inner surfaces of the pair of brake shoes 32*a* and 32*b*, there are respectively provided friction members 38*a* and 38*b* to be in contact with the brake wheel 30 to restrict rotation of the brake wheel 30 by causing resistance. On the outer side surface of extending portions 37*a* and 37*b* of the brake shoes 32*a* and 32*b*, there are fixedly attached springs 39*a* and 39*b* that can expand and contract along a direction the same as the direction in which the later-described pistons 36*a* and 36*b* can slide. The other ends of the springs 39*a* and 39*b* are fixedly attached to the end cap 8 respectively by screws 40*a* and 40*b*.

With the above-described structure, the brake shoes 32*a* and 32*b* are normally biased inwardly by the springs 39*a* and 39*b*, whereby the frictional members 38*a* and 38*b* are pressed against the brake wheel 30 to restrict rotation of the brake wheel 30. The biasing force of the springs 39*a* and 39*b* can be adjusted by changing the fixed positions of the screws 40*a* and 40*b* (i.e. the fixed positions of the screws 40*a* and 40*b* with respect to the expanding/contracting direction of the springs 39*a* and 39*b*) on the end cap 8. This enables adjustment of the restricting force in restricting inertial motion of the load. Bar-shaped stoppers 41*a* and 41*b* extending in a direction substantially parallel to the fixed shaft 11 are provided on the end cap 8 so as to limit outward swinging of the respective brake shoes 32*a* and 32*b*.

The end cap 8 has a cylinder portion 42 provided directly below the spindle portion 11*b* of the fixed shaft 11. The pair of opposed pistons 36*a* and 36*b* are provided in the cylinder portion 42 in an airtight manner. The pistons 36*a* and 36*b* and the cylinder portion 42 form a second air chamber 35. The second air chamber 35 is connected with an air supply port 8*a*. The pistons 36*a* and 36*b* are adapted to be able to slide along the direction perpendicular to the axial direction of the fixed shaft 11 as seen from above. With the above-described structure, when air is supplied through the air supply port 8*a* into the second air chamber 35, the pistons 36*a* and 36*b* are caused to slide outwardly by the air pressure as shown in FIG. 2B to press the extending portions 37*a* and 37*b* of the brake shoes 32*a* and 32*b* outwardly, whereby the friction members 38*a* and 38*b* of the brake shoes 32*a* and 32*b* are detached from the brake wheel 30 to lift or release the restriction of rotation of the brake wheel 30. The biasing force of the springs 39*a* and 39*b* acting on the respective brake shoes 32*a* and 32*b* is designed to be weaker than the force by which the pistons 36*a* and 36*b* press the extending portions 37*a* and 37*b* outwardly. As air in the second air chamber 35 is discharged through the air supply port 8*a*, the pistons 36*a* and 36*b* slide inwardly to return to the state shown in FIG. 2A, whereby rotation of the brake wheel 30 is restricted again.

As described above, the inertial motion prevention apparatus 16 in this embodiment is composed of the brake wheel 30, the shaft 31, the brake shoes 32*a*, 32*b*, and the second air chamber 35 having the above-described structure.

Figure 3B:
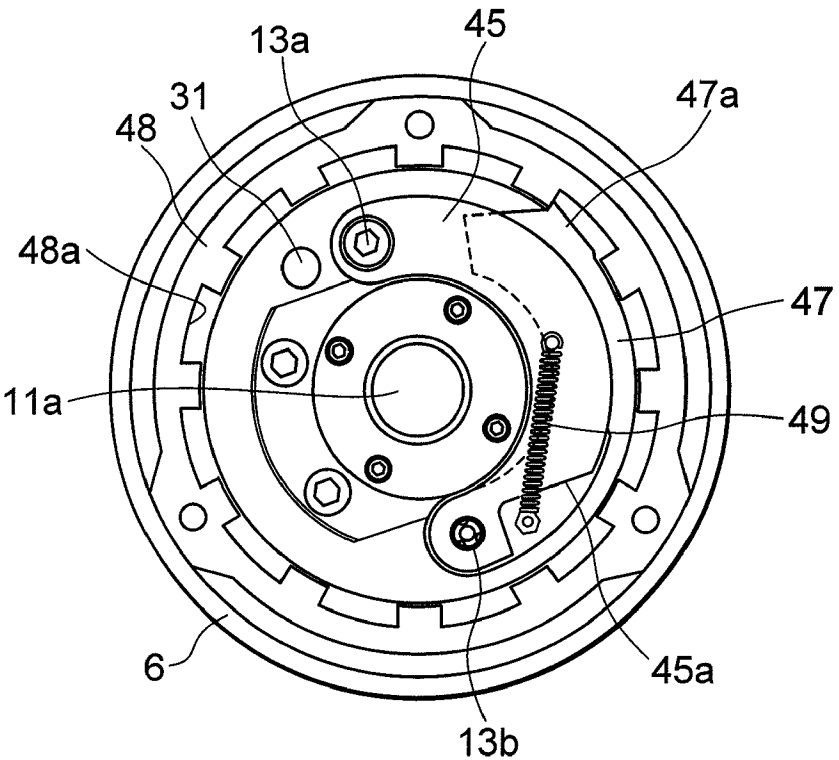
FIGS. 3A and 3B are cross sectional views taken along line B-B' in FIG. 1, showing the structure of a abrupt pulling-up or flying-up prevention apparatus 17 in the air balancer 1 according to the embodiment of the present invention.
Figure 3A:
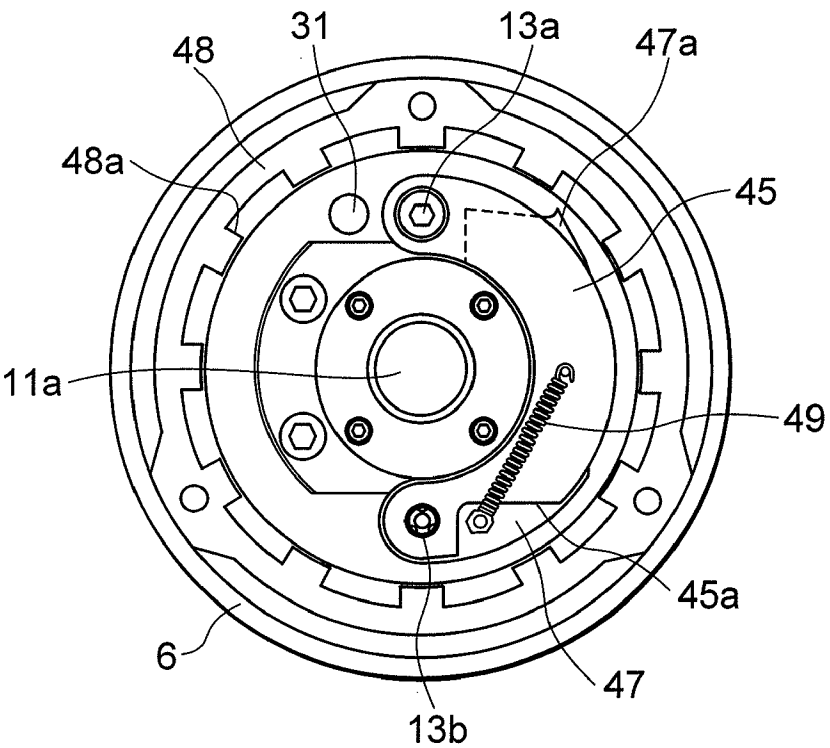

FIGS. 3A and 3B are cross sectional views taken along line B-B' in FIG. 1, showing the structure of the flying-up prevention apparatus 17 of the air balancer 1 according to the embodiment of the present invention.

The flying-up prevention apparatus 17 is intended to prevent the wire rope 18 from flying up or pulling up abruptly, when, for example, the wire rope 18 breaks while the suspended load is hanging on the lower hook 21 or the suspended load is disengaged from the hook 21, to thereby prevent the wire rope 18 from flying up at high speed to hit somebody to injure him/her or hit a structure to brake it.

As shown in FIGS. 1, 3A, and 3B, a plate 45 having a circular arc shape coaxial with the fixed shaft 11 is fixed at its both ends on the side surface of the drum 15 facing the end cap 8 by means of shafts 13*a* and 13*b*. Between the fixed plate 45 and the side surface of the drum 15, there is provided a ratchet member 47 in the form of a plate having a circular arc shape concentric with the fixed shaft 11 and having a length shorter than the fixed plate 45. One end of the ratchet member 47 is pivotally supported by the shaft 13*b* on the side surface of the drum 15. At the other end, the ratchet member 47 has an outwardly projecting pawl portion 47*a* that can engage with a toothed portion 48*a* of a ratchet wheel 48 that will be described later. The fixed plate 45 is formed with a cut-away portion 45*a*, and the fixed plate 45 and the ratchet member 47 that is exposed by virtue of the cut-away portion 45*a* are connected by a spring 49. In consequence, the ratchet member 47 is normally kept, by a compression force of the spring 49, at a position at which it is overlapped by the fixed plate 45 as shown in FIG. 3A. In this position, the ratchet member 47 is not in contact with the ratchet wheel 48.

On the other hand, the ratchet wheel 48 is provided around the outer circumference of the drum 15 in the casing 5 in such a way that it does not rotate relative to the casing body 6. The ratchet wheel 48 has a toothed portion 48*a* having ridges and grooves that are extending in the axial direction of the fixed shaft 11 provided periodically all along the inner circumferential surface thereof. The axial length of the toothed portion 48*a* of the ratchet wheel 48 is large enough that the pawl portion 47*a* of the ratchet member 47 can engage with the toothed portion 48*a* at any time even when the ratchet member 47 and the fixed plate 45 shift toward the end cap 7 with the drum 15.

With the above-described structure, when the wire rope 18 flies up or is pulled up at high speed due to, for example, disengagement of the suspended load from the lower hook 21, namely when the drum 15 rotates anticlockwise or in the direction of winding the wire rope 18 at high speed and a specific rotation speed is reached, the centrifugal force exceeds the biasing force of the spring 49, whereby the ratchet member 47 swings radially outwardly about the shaft 13*b*, and the pawl portion 47*a* engages with the toothed portion 48*a* of the ratchet wheel 48 as shown in FIG. 3B. Then, rotation of the drum 15 is stopped, and the high speed flying-up of the wire rope 18 can be prevented.

The pawl portion 47*a* of the ratchet member 47 and the toothed portion 48*a* of the ratchet wheel 48 are disengaged by lowering the lower hook 21 to rotate the drum 15 clockwise or in the direction of unwinding the wire rope 18, whereby the ratchet member 47 can return to the normal position at which it is overlapped by the fixed plate 45.

As described above, the flying-up prevention apparatus 17 in this embodiment is composed of the ratchet member 47, the ratchet wheel 48, and the spring 49 having the above-described structure.

As shown in FIG. 1, the operation handle 3 is connected to the control module 4 via four air hoses 70*a*, 70*b*, 70*c*, and 70*d*. The operation handle 3 has an UP button 50*a* for causing the drum 15 to rotate to thereby raise the lower hook 21 by winding the wire rope 18, a DOWN button 50*b* for causing the drum 15 to rotate to thereby lower the lower hook 21 by unwinding the wire rope 18, and a switch 51 for switching between ON and OFF of the inertial motion prevention apparatus 16. The internal configuration of the operation handle 3 will be described later.

Figure 4:
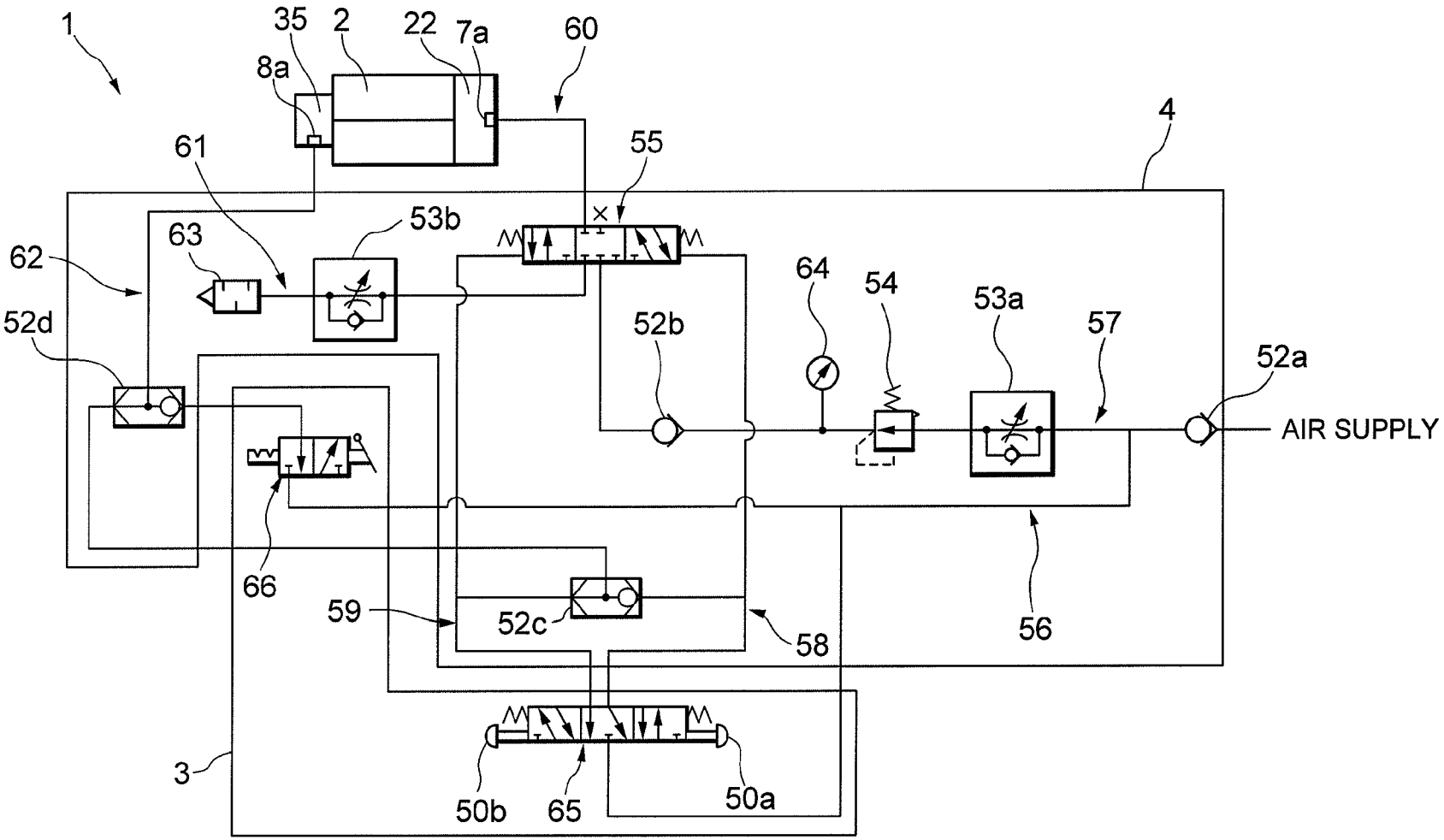
FIG. 4 is an air circuit diagram showing the internal configuration of an operation handle 3 and a control module 4 in the air balancer 1 according to the embodiment of the present invention.

FIG. 4 is an air circuit diagram showing the internal configuration of the operation handle 3 and the control module 4 of the air balancer according to the embodiment of the present invention.

As shown in FIG. 4, the control module 4 includes a plurality of valves 52*a*, 52*b*, 52*c* and 52*d*, speed controllers 53*a* and 53*b*, a regulator 54, a module switch 55, a silencer 63, a pressure sensor 64, and a plurality of channels that connect these elements (including a first supply channel 56, a second supply channel 57, a raising channel 58, a lowering channel 59, an air balancer channel 60, a discharge channel 61, and an inertial motion prevention channel 62). The module switch 55 is provided with a valve for connecting the second supply channel 57 with the air balancer channel 60, a valve for closing the second supply channel 57, and a valve for connecting the air balancer channel 60 with the discharge channel 61 and closing the second supply channel 57, which can be switched over.

The operation handle 3 has a pendant switch 65 that is turned by operating the UP button 50*a* and the DOWN button 50*b*, and an inertial motion prevention switch 66 that is turned by operating the switch 51. As shown in FIG. 4, the pendant switch 65 is provided with a valve for connecting the first supply channel 56 with the raising channel 58, a valve for closing the first supply channel 56, and a valve for connecting the first supply channel 56 with the lowering channel 59, which can be switched over. The inertial motion prevention switch 66 is provided with a valve for connecting the first supply passage 56 with the inertial motion prevention channel 62, and a valve for closing the first supply channel 56, which can be switched over.

In the following, the operation of the air balancer 1 according to this embodiment having the above-described structure will be described.

First, when supply of air from a compressor (not shown) is started upon operation of the operation handle 3 by an operator of the air balancer 1, air is delivered to the pendant switch 65 and the inertial motion prevention switch 66 of the operation handle 3 through the first supply channel 56, and to the module switch 55 through the second supply passage 57, wherein air passes through the speed controller 53*a*, the regulator 54, the pressure sensor 64, and the check valve 52*b* in order. It is assumed here that the inertial motion prevention apparatus 16 has been set to ON in advance by the switch 51 on the operation handle 3.

In this state, if the UP button 50*a* on the operation handle 3 is depressed by the operator, the first supply channel 56 is connected with the raising channel 58 by the pendant switch 65 as long as the UP button 50*a* is being depressed, whereby the second supply channel 57 is connected with the air balancer channel 60 by the module switch 55. Thus, air is supplied to the first air chamber 22 of the main body 2 of the air balancer through the air supply port 7*a*, whereby the drum 15 rotates to wind the wire rope 18, and the lower hook 21 is raised with the suspended load. During this process, the first supply channel 56 leading to the inertial motion prevention switch 66 is closed by the inertial motion prevention switch 66, and consequently air in the channel branching off from the raising channel 58 is introduced into the second air chamber 35 of the main body 2 of the air balancer via two shuttle valves 52*c* and 52*d* in order. Thus, air is supplied into the second air chamber 35 through the air supply port 8*a*, whereby restriction of rotation of the brake wheel 30 in the inertial motion prevention apparatus 16 is lifted, and the drum 15 is allowed to rotate freely.

When the operator releases the UP button 50*a* on the operation handle 3, the first supply channel 56 is closed by the pendant switch 65. Consequently, supply of air into the first air chamber 22 in the main body 2 of the air balancer is stopped, and the lower hook 21 and the suspended load stop rising. At this time, supply of air into the second air chamber 35 in the main body 2 of the air balancer is also stopped, and consequently rotation of the brake wheel 30 is restricted in the inertial motion prevention apparatus 16, whereby the drum 15 immediately stops rotating with the brake wheel 30. Thus, the lower hook 21 and the suspended load can be stopped without an inertial motion. The lower hook 21 and the suspended load that have stopped rising are kept at the level they were at when stopped.

On the other hand, if the DOWN button 50*b* on the operation handle 3 is depressed by the operator, the first supply channel 56 is connected with the lowering channel 59 by the pendant switch 65 as long as the DOWN button 50*b* is being depressed, whereby the second supply channel 57 is closed and the air balancer channel 60 is connected with the discharge channel 61 by the module switch 55. Thus, air is discharged from the first air chamber 22 in the main body 2 of the air balancer through the air supply port 7*a*, and through the speed controller 53*b* and the silencer 63, and consequently the lower hook 21 and the suspended load can be lowered by their own weight. During this process, the first supply channel 56 leading to the inertial motion prevention switch 66 is closed by the inertial motion prevention switch 66, and consequently air in the channel branching off from the lowering channel 59 is introduced into the second air chamber 35 of the main body 2 of the air balancer via two shuttle valves 52*c* and 52*d* in order. Thus, air is supplied into the second air chamber 35 through the air supply port 8*a*, whereby restriction of rotation of the brake wheel 30 in the inertial motion prevention apparatus 16 is lifted or released, and the drum 15 is allowed to rotate freely.

When the operator releases the DOWN button 50*b* on the operation handle 3, the first supply channel 56 is closed by the pendant switch 65. Consequently, discharge of air from the first air chamber 22 in the main body 2 of the air balancer is stopped, and the lower hook 21 and the suspended load stop lowering. At this time, supply of air into the second air chamber 35 in the main body 2 of the air balancer is also stopped, and consequently rotation of the brake wheel 30 is restricted in the inertial motion prevention apparatus 16, whereby the drum 15 immediately stops rotating with the brake wheel 30. Thus, the lower hook 21 and the suspended load can be stopped without an inertial motion. The lower hook 21 and the suspended load that have stopped lowering are kept at the level they were at when stopped. When detaching the suspended load from the lower hook 21, it is desirable to lower the lower hook 21 until the suspended load lands on the floor to loosen the tension of the wire rope 18.

As described in the foregoing, the operator can raise and lower the suspended load using the air balancer 1 by operating the UP button 50*a* and the DOWN button 50*b* on the operation handle 3.

As described above, when the inertial motion prevention apparatus 16 is on, rotation of the brake wheel 30 and the drum 15 is restricted by the inertial motion prevention apparatus 16 normally, and the restriction of rotation of the brake wheel 30 and the drum 15 is lifted only while the UP button 50*a* or the DOWN button 50*b* on the operation handle 3 is being depressed by the operator. In consequence, when the operator stops raising or lowering the suspended load, namely when the operator releases the UP button 50*a* or the DOWN button 50*b*, rotation of the drum 15 is restricted immediately by the inertial motion prevention apparatus 16, whereby inertial motion of the suspended load can be prevented appropriately.

In this air balancer 1, when the inertial motion prevention apparatus 16 is turned off by the operation of the switch 51 on the operation handle 3, the first supply channel 56 is connected with the inertial motion prevention channel 62 by the inertial motion prevention switch 66 shown in FIG. 4. Consequently, air is always supplied to the second air chamber 35 of the main body 2 of the air balancer irrespective of the operation state of the UP button 50*a* and the DOWN button 50*b*. Thereby, restriction of rotation of the brake wheel 30 in the inertial motion prevention apparatus 16 is lifted, and the drum 15 is allowed to rotate freely. Thus, the inertial motion prevention apparatus 16 is brought into the OFF state.

With the above-described configuration, while the operator can raise or lower the suspended load by his/her hands even when the inertial motion prevention apparatus 16 is on, he/she can raise or lower the suspended load by hands with smaller force when the inertial motion prevention apparatus 16 is off.

As described in the foregoing, in the air balancer according to this embodiment, when the suspended load is raised or lowered to a desired stopping position, the suspended load can be favorably prevented from moving up or down by inertia. Thus, the transportation of the load by hoisting and moving to a target site can be performed stably. In addition, it is possible to stop and keep the suspended load stationary at a desired level with high precision.

Although in this embodiment the switch 51 of the inertial motion prevention apparatus 16 is provided on the operation handle 3 with a view to facilitate the usability, the location of the switch 51 is not limited to this. For example, the switch 51 may be provided on the control module 4. In this case, the number of air hoses between the control module 4 and the operation handle 3 can be reduced, and the size of the operation handle 3 can also be reduced.

The control module 4 in this embodiment may be provided with a known mount structure for integral mounting on the main body 2 of the air balancer.

In this embodiment, the flying-up prevention apparatus 17 is adapted to move along the axial direction of the fixed shaft 11 while rotating with the drum 15. However, this is not limiting. The shafts 13*a* and 13*b* connecting the flying-up prevention apparatus 17 and the drum 15 may be designed to have a sufficient length, as with the shaft 31 of the inertial motion prevention apparatus 16, so that they can move inside the drum 15 to allow rotation of the flying-up prevention apparatus 17 at a fixed position as the drum 15 moves along the axial direction of the fixed shaft 11 while rotating. In this case, in the flying-up prevention apparatus 17, the toothed portion 48*a* of the ratchet wheel 48 may be provided only on the portion opposed to the pawl portion 47*a* of the ratchet 47. Therefore, the ratchet wheel does not need to be elongated along the axial direction of the fixed shaft 11, and the cost thereof can be reduced.

What is claimed is:

1. An air balancer comprising:

a rotary drum on which a rope member is to be wound, the rotary drum being rotatably supported by a stationary shaft in a casing;

a conversion system that converts pressure of first air supplied into said casing into rotational force of said rotary drum for winding the rope member on said rotary drum;

a cylindrical rotary member that is rotatably supported by said stationary shaft and linked with said rotary drum to integrally rotate therewith;

a rotation restriction mechanism that comprises a pair of substantially semi-circular brake shoes that are pressed radially inwardly from radially opposite sides of the rotary member into contact with an outer circumferential surface of said rotary member, thereby restricting rotation of said rotary member;

a disengagement mechanism that causes said brake shoes to retract radially outwardly by pressure of second air supplied into said casing to thereby disengage the contact between said rotary member and said brake shoes; and a control module having an air circuit that supplies said second air into said casing only when said first air is supplied into or discharged from said casing.

2. An air balancer according to claim 1, wherein said disengagement mechanism comprises a stationary cylinder member and a pair of piston members held in said cylinder member at both ends thereof to form a piston chamber into which said second air is supplied to move said piston members, one end of each of said brake shoes is rotatably supported by a common stationary shaft and other ends of said brake shoes are respectively opposed to said pair of piston members so that both the piston members are located between said other ends of said brake shoes, and said rotation restriction mechanism further comprises a pair of biasing members for biasing said other ends of said brake shoes so that said brake shoes are pressed into contact with said outer circumferential surface of said rotary member.

3. An air balancer according to claim 2, further comprising a pair of fixing members that respectively fix said pair of biasing members in said casing, wherein the biasing force of said pair of biasing members can be adjusted by changing a fixing position of each biasing member of said pair of biasing members in said casing via respective ones of said fixing members.

4. An air balancer according to claim 3, wherein said control module further comprises a switching air circuit for supplying said second air always into said casing, and the air balancer further comprises switching means for selectively enabling said air circuit and said switching air circuit in said control module.

5. An air balancer according to claim 3 further comprising a lock mechanism including an engaging member that is provided on an end surface of said rotary drum in such a way as to be able to swing toward the outer circumference thereof, a restricting member that restricts swinging of said engaging member until the rotation speed of said rotary drum reaches a specific level, and an engaged member provided outside the outer circumference of said rotary drum.

6. An air balancer according to claim 2, wherein said control module further comprises a switching air circuit for supplying said second air always into said casing, and the air balancer further comprises switching means for selectively enabling said air circuit and said switching air circuit in said control module.

7. An air balancer according to claim 6, further comprising a lock mechanism including an engaging member that is provided on an end surface of said rotary drum in such a way as to be able to swing toward the outer circumference thereof, a restricting member that restricts swinging of said engaging member until the rotation speed of said rotary drum reaches a specific level, and an engaged member provided outside the outer circumference of said rotary drum.

8. An air balancer according to claim 2, further comprising a lock mechanism including an engaging member that is provided on an end surface of said rotary drum in such a way as to be able to swing toward the outer circumference thereof, a restricting member that restricts swinging of said engaging member until the rotation speed of said rotary drum reaches a specific level, and an engaged member provided outside the outer circumference of said rotary drum.

9. An air balancer according to claim 1, wherein said control module further comprises a switching air circuit for supplying said second air always into said casing, and the air balancer further comprises switching means for selectively enabling said air circuit and said switching air circuit in said control module.

10. An air balancer according to claim 9 further comprising a lock mechanism including an engaging member that is provided on an end surface of said rotary drum in such a way as to be able to swing toward the outer circumference thereof, a restricting member that restricts swinging of said engaging member until the rotation speed of said rotary drum reaches a specific level, and an engaged member provided outside the outer circumference of said rotary drum.

11. An air balancer according to claim 1, further comprising a lock mechanism including an engaging member that is provided on an end surface of said rotary drum in such a way as to be able to swing toward the outer circumference thereof, a restricting member that restricts swinging of said engaging member until the rotation speed of said rotary drum reaches a specific level, and an engaged member provided outside the outer circumference of said rotary drum.

* * * * *